US005469945A

United States Patent [19]

Jserng

[11] Patent Number: 5,469,945

[45] Date of Patent: Nov. 28, 1995

[54] FOLDAWAY LUGGAGE PULL HANDLE

[76] Inventor: Yueh-Chy Jserng, 26-21, Hsi-Shih Chuang, Chang-Hua City, Taiwan

[21] Appl. No.: 280,669

[22] Filed: Jul. 27, 1994

[51] Int. Cl.[6] ..... A45C 13/26

[52] U.S. Cl. ..... 190/115; 190/18 A; 190/39; 16/112; 16/115

[58] Field of Search ..... 16/112, 115; 190/39, 190/18 A, 115, 116; 280/47, 371, 655.1, 37, 655, 315

[56] References Cited

U.S. PATENT DOCUMENTS

| | | | |
|---|---|---|---|
| 1,689,044 | 10/1928 | Meyer | 190/116 X |
| 2,596,578 | 5/1952 | McIntyre et al. | 190/18 A X |
| 2,675,101 | 4/1954 | Bartlett | 280/655.1 X |
| 3,185,272 | 5/1965 | Chance | 190/39 X |
| 3,372,780 | 3/1968 | Fujioka et al. | 16/115 |
| 4,261,077 | 4/1981 | Brock et al. | 190/39 X |
| 5,062,179 | 11/1991 | Huang | 280/47.371 X |
| 5,165,508 | 11/1992 | Kim | 190/115 |
| 5,184,835 | 2/1993 | Huang | 280/655.1 X |
| 5,330,037 | 7/1994 | Wang | 190/39 X |

FOREIGN PATENT DOCUMENTS

| | | | |
|---|---|---|---|
| 531818 | 1/1958 | Italy | 280/655.1 |
| 373671 | 6/1932 | United Kingdom | 190/115 |
| 811826 | 4/1959 | United Kingdom | 190/115 |

*Primary Examiner*—Sue A. Weaver
*Attorney, Agent, or Firm*—Bacon & Thomas

[57] ABSTRACT

A foldaway luggage pull handle includes a handle having a pivot joint pivotally fastened to a suitcase by a mounting plate and a locating plate. The pivot joint consists of a polygonal shaft, a pair of inner knobs mounted around the shaft and secured against rotary motion relative to the shaft, a spring stopped between the inner knobs, and a pair of outer knobs turned by the shaft and respectively meshed with the inner knobs, wherein when the handle is turned, the outer knobs are disengaged from the inner knobs, thus permitting the handle to be moved to a desired angle, so that when the handle is released, the outer and inner knobs are meshed into engagement, thus again causing the handle to be firmly retained in the adjusted position.

3 Claims, 5 Drawing Sheets

FOLDAWAY LUGGAGE PULL HANDLE

BACKGROUND OF THE INVENTION

The present invention relates to a foldaway luggage pull handle for a suitcase or similar travel article which can be turned outwards from the suitcase and retained at any of a series of angles.

Various travel bags and luggage, such as a suitcase, have been disclosed for travelers, and have appeared on the market. These travel bags and luggage are commonly equipped with wheels at the bottom and a retractable handle at one side such that they can be conveniently moved on the ground. The retractable handle may be mounted outside a suitcase or concealed inside the suitcase. The retractable handle can be pulled out of the suitcase when in use, or collapsed therein when not in use. Conventional retractable handles for suitcase are commonly complicated. The common drawback of conventional retractable handles is that they cannot be adjusted to the desired angle relative to the suitcase. If the retractable handle is made turnable, a complicated pivot joint or like device must be installed.

SUMMARY OF THE INVENTION

The present invention has been accomplished in view of the above considerations. It is therefore the principal object of the present invention to provide a foldaway pull handle for a suitcase which can be adjusted to any of a series of angular positions relative to the suitcase. It is another object of the present invention to provide a foldaway pull handle for a suitcase which is simple in structure.

According to one aspect of the present invention, the foldaway luggage pull handle is comprised of a handle having a pivot joint at one end pivotally fastened to the suitcase by a mounting plate and a locating plate.

According to another aspect of the present invention, the pivot joint is comprised of two pairs of meshed knobs respectively mounted around a shaft. By changing the engagement of the knobs, the angular position of the handle is adjusted.

According to still another aspect of the present invention, a spring is mounted around the shaft and stopped between the knobs such that the knobs are disengaged for allowing the angular position of the handle to be adjusted when the handle is turned.

According to still another aspect of the present invention, the handle can be turned inwards and closely attached to the suitcase when not in use.

DETAILED DESCRIPTION OF THE PREFERRED EMBODIMENT

Figure 1:
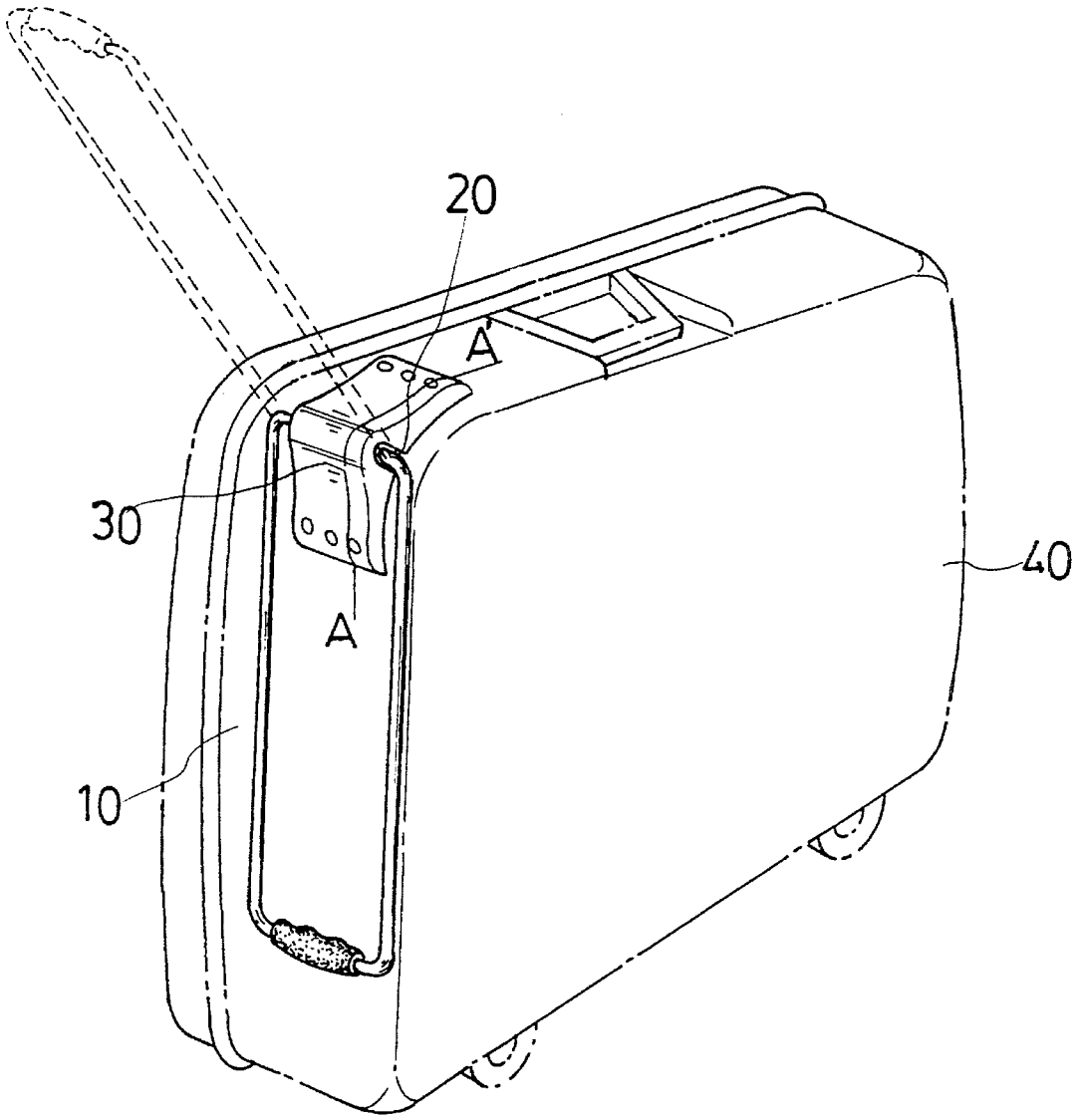
FIG. 1 is a perspective view showing a foldaway suitcase pull handle mounted on a luggage.
Figure 2:
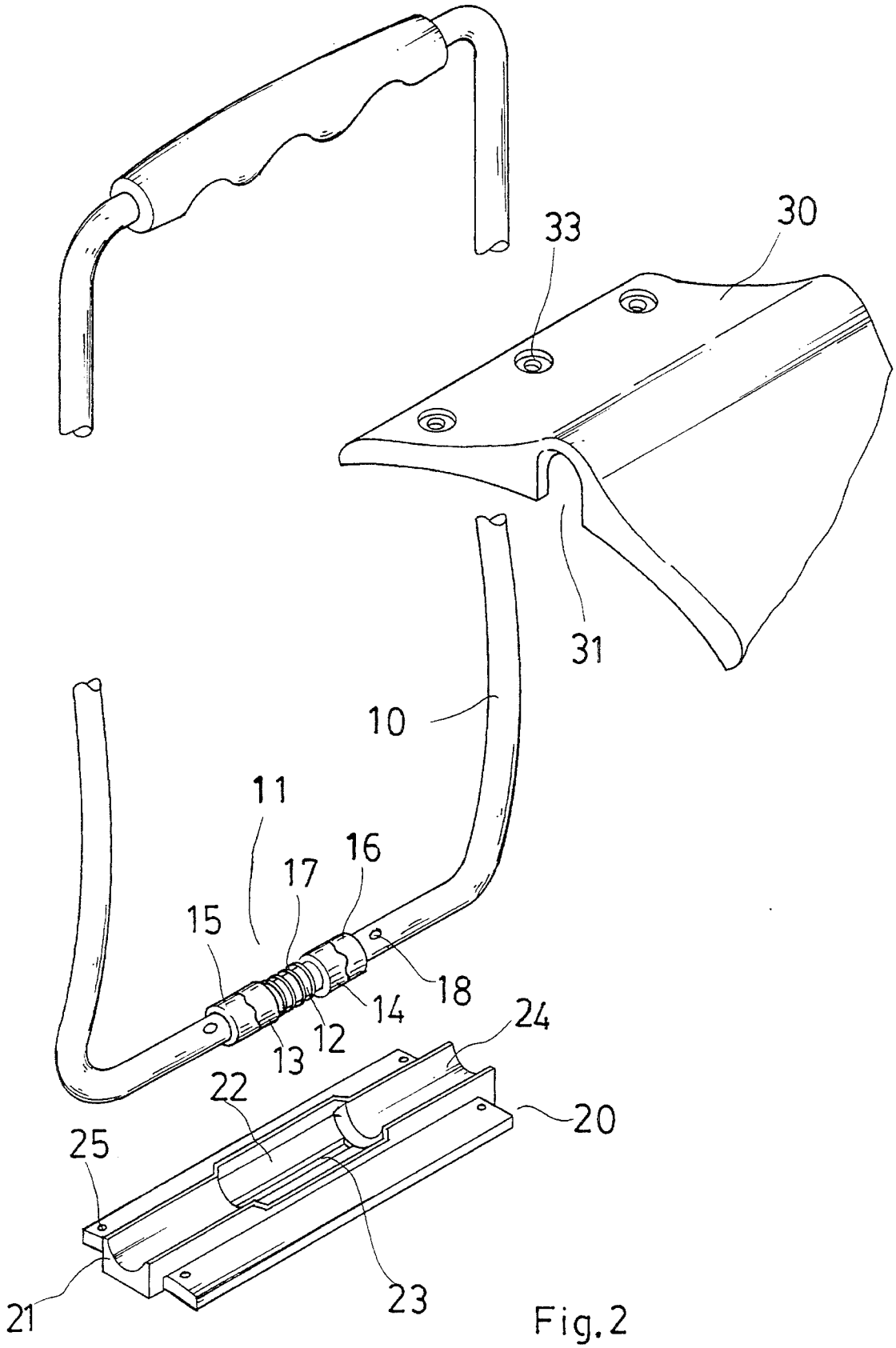
FIG. 2 is an exploded perspective view of the foldaway luggage pull handle shown in FIG. 1.
Figure 3:
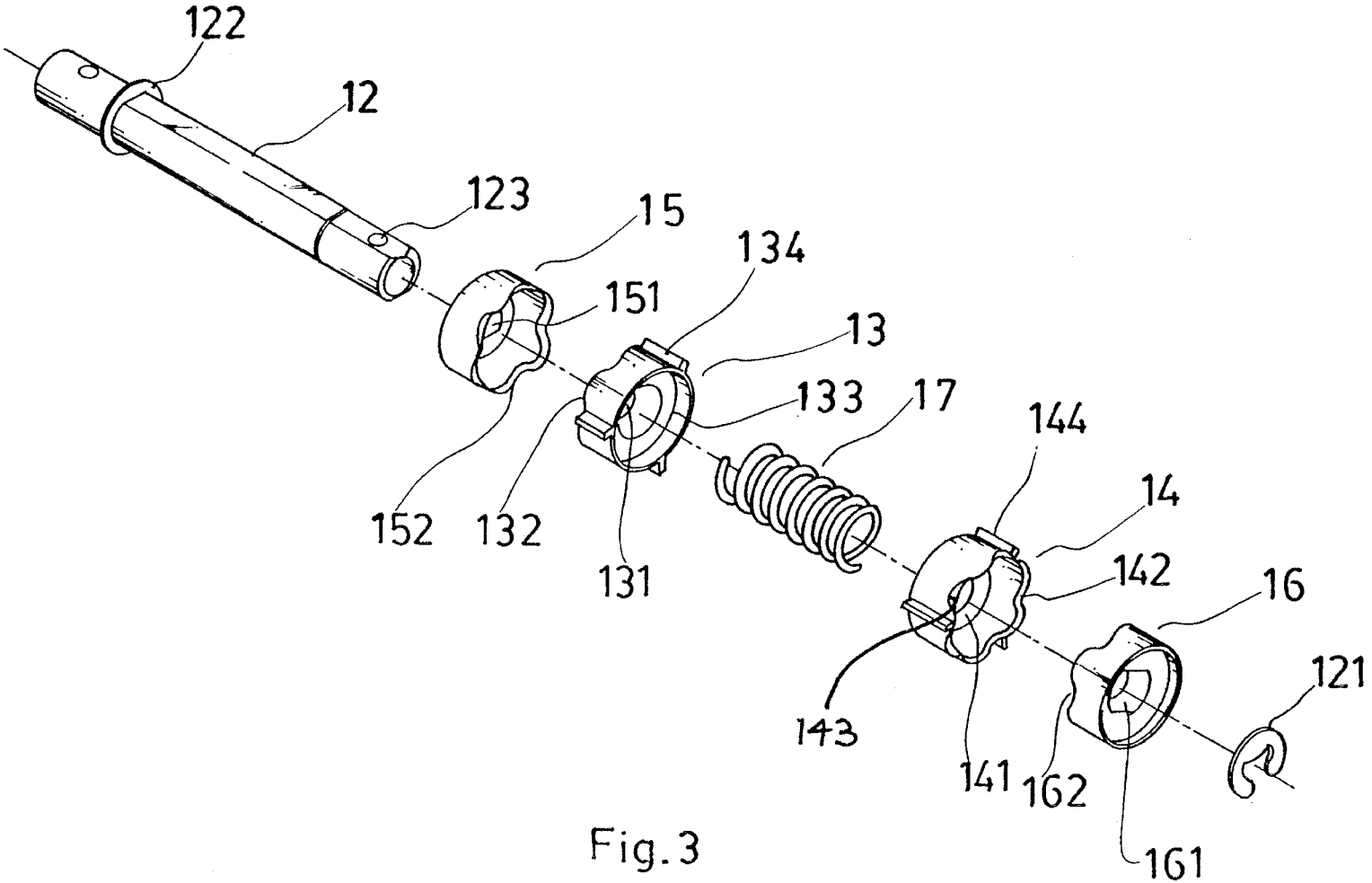
FIG. 3 is an exploded perspective view of the pivot joint shown in FIG. 2.

Referring to FIGS. 1 through 5, the pull handle 10 is shaped like a rectangular open frame, having a pivot joint 11 at one end pivotally fastened to a suitcase 40 by a mounting plate 20 and a locating plate 30. The pivot joint 11 comprises a shaft 12, two inner locating knobs 13 and 14, two outer locating knobs 15 and 16, and a spring 17. The shaft 12 is a polygonal rod having two pin holes 123 at two opposite ends and a collar 122 near one end. The inner locating knob 13 or 14 has a circular center through hole 131 or 141 of a diameter slightly larger than the outer diameter of the shaft 12. The outer locating knob 15 or 16 has a polygonal center through hole 151 or 161 of a diameter approximately equal to the outer diameter of the shaft 12, and a serrated portion 152 or 162 at one end around the center through hole 151 or 161. The inner locating knob 13 or 14 further comprises a serrated portion 132 or 142 at one end for engagement with the serrated portion 152 or 162 of the outer locating knob 15 or 16, an annular groove 133 or 143 at an opposite end, which receives either end of the spring 17, and a plurality of fins 134 or 144 spaced around the periphery. The inner and outer locating knobs 13, 14, 15 and 16 and the spring 17 are respectively mounted around the shaft 12 and then a clamp 121 is fastened to the shaft 12 to secure the outer locating knobs 15, 16 and the spring 17 in place. When assembled, the two opposite ends of the spring 17 are respectively received in the annular grooves 133 and 143 of the inner locating knobs 13 and 14, the outer locating knobs 15 and 16 are respectively stopped at the collar 122 and the clamp 121 with the serrated portions 152 and 162 respectively meshed with the serrated portions 132 and 142 of the inner locating knobs 13 and 14. The pull handle 10 is made from a tube bent into the shape of a rectangular open frame having two opposite ends respectively connected to the pin holes 123 of the shaft 12 by a respective pin 18.

The mounting plate 20 comprises a receiving open chamber 21 at the top, which consists of a deep open chamber 22 in the middle and two shallow open chambers 24 at two opposite sides, an elongated groove 23 in the deep open chamber 22, and a plurality of mounting holes 25 around the border. The deep open chamber 22 receives outer locating knobs 15 and 16 and the inner locating knobs 13 and 14. The shallow open chambers 24 receive the pull handle 10. The elongated groove 23 receives either fin 134 or 144 of each inner locating knob 13 and 14. The locating plate 30 fits over one corner of the suitcase 40, plate 30 includes a recess 301 at the bottom for receiving the mounting plate 20, a receiving open chamber 31 defined within the recess 301 and matching the receiving open chamber 21 of the mounting plate 20, a plurality of first mounting holes 32 in the recess 301 for respectively connecting to the mounting holes 25 on the mounting plate 20, and a plurality of second mounting holes 33 for respectively fastening to the suitcase 40. Open chamber 31 also includes a deep open chamber 36 in the middle and two shallow open chambers 38 at two opposite sides.

Figure 4:
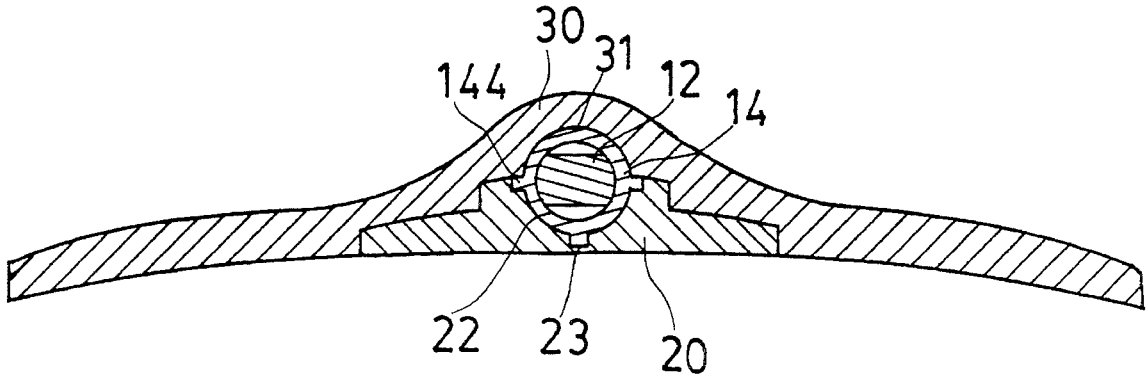
FIG. 4 is a sectional view taken along line A—A' of FIG. 1.
Figure 5:
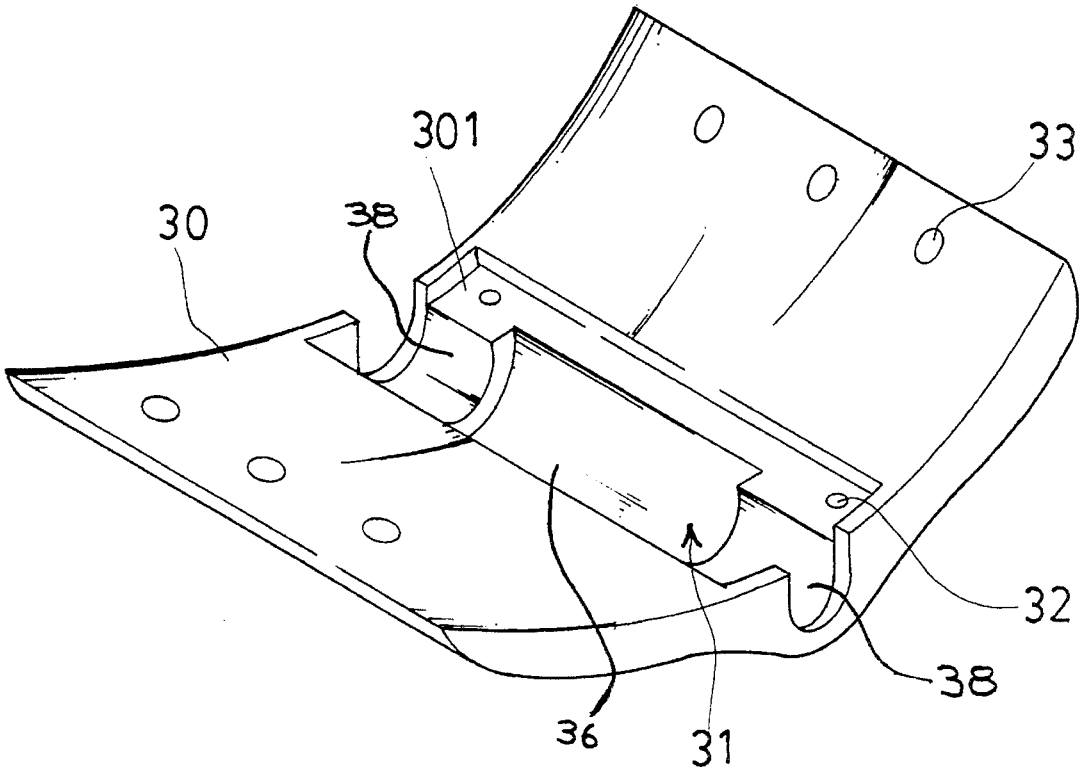
FIG. 5 is a perspective bottom view of the locating plate shown in FIG. 2.
Figure 6:
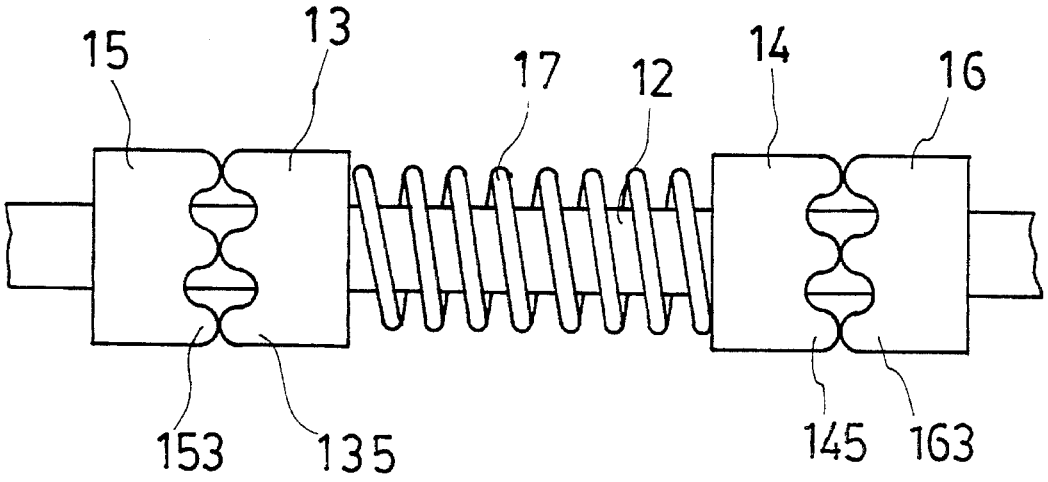
FIG. 6 is a longitudinal plan view of the pivot joint shown in FIG. 2, showing the outer and inner knobs disengaged from each other.
Figure 7:
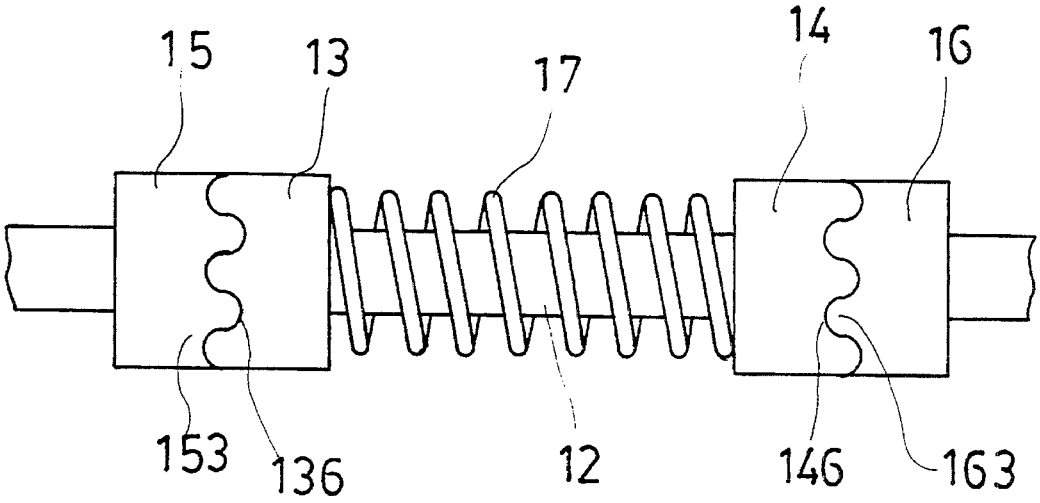
FIG. 7 is similar to FIG. 6 but showing the outer and inner knobs engaged with each other.

When installed, the locating plate 30 is covered over the mounting plate 20, and, the pivot joint 11 is received within the receiving open chambers 21 and 31 (see FIG. 4). Because one fin 134 or 144 of each inner locating knob 13 and 14 is received in the elongated groove 23, the inner locating knobs 13 and 14 are prohibited from rotary motion relative to the mounting plate 20 and the locating plate 30. When the pull handle 10 is turned and folded away from suitcase 40, the outer locating knobs 15 and 16 are synchronously turned relative to the inner locating knobs 13 and 14 to disengage therefrom. When the tooth crests 153 and 163 of the serrated portions 152 and 162 of the outer locating knobs 15 and 16 are respectively end matched with the tooth crests 135 and 145 of the serrated portions 132 and 142 of the inner locating knobs 13 and 14, the spring 17 is compressed (see FIG. 6). When the tooth crests 153 and 163 of the serrated portions 152 and 162 of the outer locating knobs 15 and 16 are respectively aligned with the roots of tooth 136 and 146 of the inner locating knobs 13 and 14, the spring 17 pushes the inner locating knobs 13 and 14 outwards causing the outer locating knobs 15 and 16 and the inner locating knobs 13 and 14 to be respectively engaged again. When the outer locating knobs 15 and 16 and the inner locating knobs 13 and 14 are engaged respectively, the pull handle 10 is firmly retained in position. Therefore, the angular position of the pull handle 10 relative to the suitcase 40 can be conveniently adjusted.

While only one embodiment of the present invention has been shown and described, it will be understood that various modifications and changes could be made without departing from the spirit and scope of the invention.

I claim:

1. A pull handle mounted to an article of luggage comprising:

a) a mounting plate including means for attachment to an article of luggage, the mounting plate further including a pair of longitudinally aligned shallow open chambers and a deep open chamber positioned between the shallow open chambers, the deep open chamber having a longitudinal groove extending along the middle thereof;

b) a locating plate including means for bridging over the mounting plate, the locating plate further including a pair of shallow open chambers corresponding to the pair of shallow open chambers of the mounting plate and a deep open chamber corresponding to the deep open chamber of the mounting plate;

c) a pivot joint disposed within the corresponding deep open chambers of the mounting and locating plates, the pivot joint including a polygonal shaft, a pair of outer knobs including means for mounting on the shaft for rotation therewith, a pair of inner knobs including means for slidably mounting on the shaft between the outer knobs and including means engagable with the longitudinal groove of the mounting plate for preventing the inner knobs from rotating relative to the shaft, each inner knob and each outer knob including a corresponding serrated portion defined by tooth crests and tooth roots disposed for contact between the inner and outer knobs, means biasing the inner knobs outwardly along the shaft to dispose the corresponding serrated portions of the inner and outer knobs into engagement with each other; and d) a rectangular-shaped handle including a pair of opposed tubular ends, the tubular ends being secured within opposite ends of the polygonal shaft by securing means and disposed within the corresponding shallow open chambers of the mounting and locating plates, whereby when the handle is turned relative to the pivot joint, the polygonal shaft and outer knobs are caused to rotate relative to the inner knobs such that corresponding tooth crests engage and cause the inner knobs to be urged inwardly against the biasing means and permit the corresponding serrated portions of the inner and outer knobs to be selectively repositioned with the tooth crests engaging corresponding tooth roots for maintaining the handle at a desired angle relative to the article of luggage.

2. The pull handle of claim 1 wherein:

a) the biasing means includes a coil spring mounted on the polygonal shaft and including first and second ends; and b) each of the inner knobs includes an inwardly directed groove within which the first and second ends of the spring are engaged.

3. The pull handle of claim 1 wherein the polygonal shaft further includes:

a) a pair of clamps disposed outwardly of the outer knobs for securing the outer knobs on the shaft; and b) the securing means including a pair of pin holes at opposite ends of the shaft, a pair of pins, and the tubular ends of the handle being secured to the shaft through engagement of the pins within the pin holes.

* * * * *